US007604158B1

(12) United States Patent
Bond

(10) Patent No.: US 7,604,158 B1
(45) Date of Patent: Oct. 20, 2009

(54) MULTI-UNIT MAILBOX WITH REPLACEABLE LETTER DROP STRUCTURE

(75) Inventor: James Bond, Spartanburg, SC (US)

(73) Assignee: Bommer Industries, Inc., Landrum, SC (US)

( * ) Notice: Subject to any disclaimer, the term of this patent is extended or adjusted under 35 U.S.C. 154(b) by 0 days.

(21) Appl. No.: 12/398,299

(22) Filed: Mar. 5, 2009

Related U.S. Application Data

(60) Provisional application No. 61/068,315, filed on Mar. 6, 2008.

(51) Int. Cl.
*A47G 29/14* (2006.01)

(52) U.S. Cl. ..... 232/25; 232/24; 232/45

(58) Field of Classification Search ..... 232/25, 232/24, 19–21, 17, 45; 211/10; 312/292; 220/523, 524, 254.1
See application file for complete search history.

(56) References Cited

U.S. PATENT DOCUMENTS 1,459,031 A * 6/1923 Murphy ..... 232/25
1,817,191 A * 8/1931 Harmony ..... 232/24
4,161,274 A * 7/1979 Bishop et al. ..... 232/24
5,794,844 A * 8/1998 Jenkins ..... 232/25
5,820,018 A * 10/1998 Stacy ..... 232/24
6,247,641 B1 * 6/2001 Noblet et al. ..... 232/17
6,889,894 B2 * 5/2005 Yong ..... 232/25
2006/0151588 A1 * 7/2006 Mikolajczyk et al. ..... 232/24

* cited by examiner

*Primary Examiner*—William L. Miller
(74) *Attorney, Agent, or Firm*—Leydig, Voit & Mayer, Ltd.

(57) ABSTRACT

A multi-user mail box including a letter drop assembly which is susceptible to easy replacement by a delivery person without requiring substantial disassembly of the mail box. The letter drop assembly includes a slotted body held in inserted relation between cross-bars extending transverse to vertical frame members of an access door structure. The slotted body includes upper and lower open grooves oriented in opposing relation to the adjacent cross-bars. Retention pin elements are inserted axially into the grooves thereby holding the slotted body in place. The slotted body may be replaced by displacement of the retention pin elements.

17 Claims, 5 Drawing Sheets

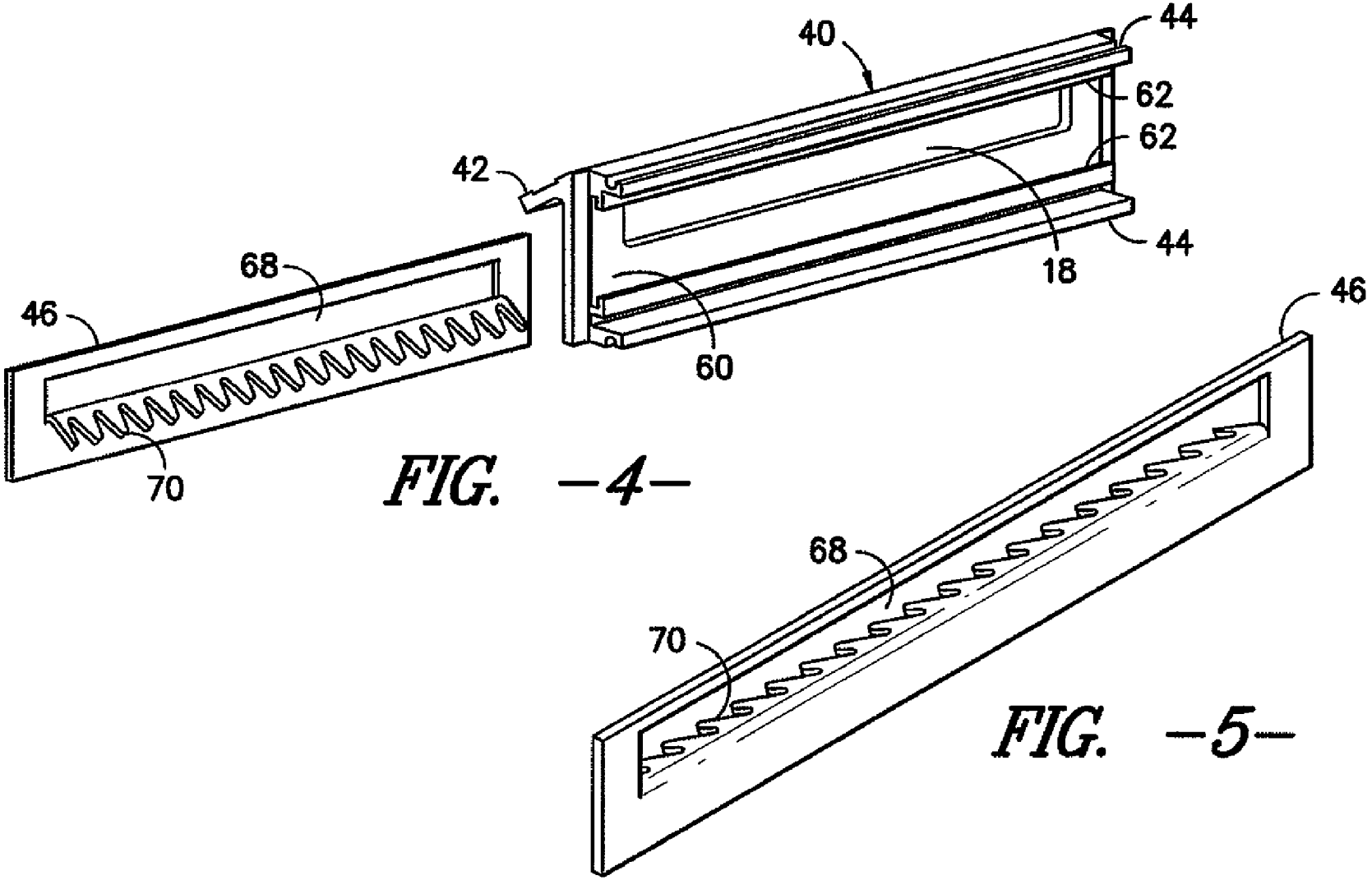
FIG. —4—
FIG. —5—

MULTI-UNIT MAILBOX WITH REPLACEABLE LETTER DROP STRUCTURE

CROSS-REFERENCE TO RELATED APPLICATIONS

This application claims the benefit of and priority from U.S. provisional application 61/068,315 filed Mar. 6, 2008 in the name of James R. Bond, the contents of which are hereby incorporated by reference in their entirety as if fully set forth herein.

TECHNICAL FIELD

This patent disclosure relates generally to mail box units and, more particularly, to multi-unit mail box structures having one or more built-in letter drops accessible for the deposit of letters and/or packages by users from the exterior.

BACKGROUND

In many environments, mail in the form of letters and/or packages is received at a central location using containment structures having multiple storage receptacles. Typically, these storage receptacles are individually accessible by users through the use of keys, combination locks or other access mechanisms as will be well known to those of skill in the art. Such containment structures are typically referred to as central box units or "CBU's". In this regard, it is to be understood that the term "mail" is intended to include not only governmental postal delivery but also to delivery of letters and/or packages by non-governmental entities. Thus, it is intended that units consistent with this disclosure may find application in both governmental and non-governmental delivery systems.

Central box units typically include one or more deposit slots for general use by persons wishing to have letters and/or packages picked up for subsequent delivery to another location. Such deposit slots are generally constructed to avoid incursion by the elements. However, they must also be sufficiently accessible to permit relatively easy deposit. Deposit slots may be prone to damage during the life of the central box unit due to the relatively high levels of use, misuse, and/or theft attempts. Historically, when a deposit slot has been damaged, it was necessary to engage in a relatively complex disassembly of the central box unit to fix the damaged slot. This disassembly and repair operation often involved the removal of an entire access door or other large structure and was generally beyond the capabilities of the regular delivery person.

SUMMARY

The present invention offers advantages and alternatives over the prior practices by providing a letter drop assembly adapted for use within a central box unit which is susceptible to easy replacement by a delivery person without requiring substantial disassembly of the central box unit. The letter drop assembly includes a slotted body held in inserted relation between cross-bars extending transverse to vertical frame members of an access door structure. The slotted body includes upper and lower open grooves oriented in opposing relation to the adjacent cross-bars. Retention pin elements are inserted axially into the grooves thereby holding the slotted body in place. The slotted body may be replaced by displacement of the retention pin elements.

According to one aspect, a multi-user mail box unit including at least one deposit opening is provided. The mail unit includes multiple individually accessible interior storage compartments. At least one general access door is adapted to open and close in relation to the interior. The general access door includes an inboard vertical frame member and an outboard vertical frame member. At least one removable letter drop assembly is supported within the general access door between a first crossbar and a second crossbar. The first crossbar and the second crossbar are in spaced relation to one another and extend between the inboard vertical frame member and the outboard vertical frame member. The letter drop assembly includes a body portion having a length dimension oriented transverse to the inboard vertical frame member and the outboard vertical frame member. The body portion includes a slot defining the deposit opening. The body portion includes a first open groove extending in the length dimension along an upper edge of the body portion. The first open groove is in opposing relation to the first crossbar. The body portion includes a second open groove extending in the length dimension along a lower edge of the body portion. The second open groove is in opposing relation to the second crossbar. A displaceable first elongate pin element normally extends across the inboard vertical frame member and axially through the first open groove. The first elongate pin element includes a first distal tip normally projecting into a first receiving opening within the outboard vertical frame member. The first elongate pin element is axially moveable within the first open groove. The first open groove is adapted to block radial displacement of the first elongate pin element when the first elongate pin element is within the first open groove. A displaceable second elongate pin element normally extends across the inboard vertical frame member and axially through the second open groove. The second elongate pin element includes a second distal tip normally projecting into a second receiving opening within the outboard vertical frame member. The second elongate pin element is axially moveable within the second open groove. The second open groove is adapted to block radial displacement of the second elongate pin element when the second elongate pin element is within the second open groove.

BRIEF DESCRIPTION OF THE DRAWINGS

The following drawings which are incorporated in and which constitute a part of this specification illustrate several exemplary embodiments and constructions consistent with this disclosure wherein:

FIG. 4 is an exploded perspective view illustrating a subassembly of the removable letter drop assembly in FIG. 3 incorporating a slotted body panel and a slidably insertable anti-fishing security screen;

FIG. 5 is perspective view of an exemplary anti-fishing security screen.

Figure 1:
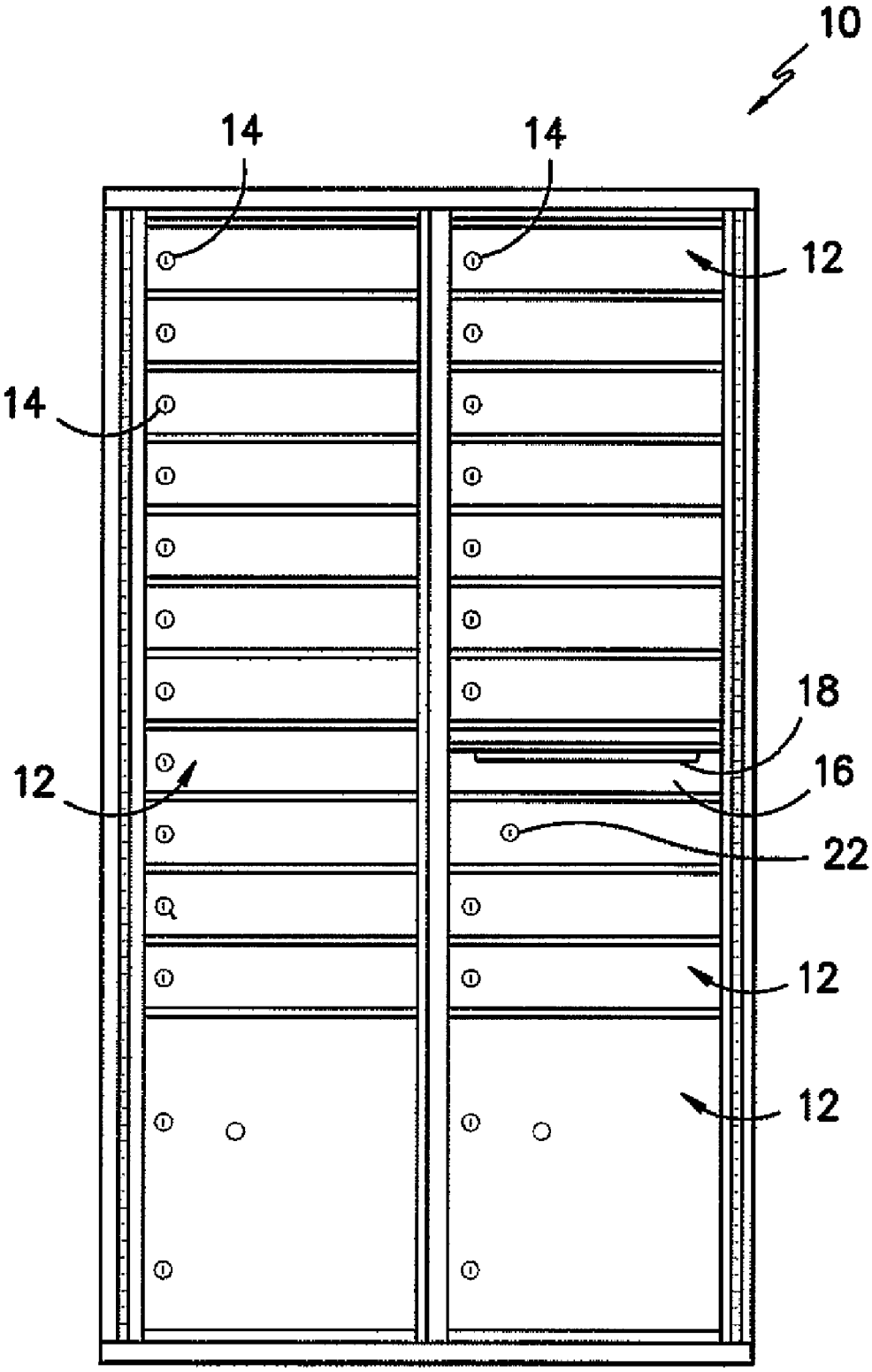
FIG. 1 is a face view of an exemplary central box unit including a removable letter drop assembly.

Before the exemplary embodiments of the invention are explained in detail, it is to be understood that the invention is in no way limited in its application or construction to the details and the arrangements of the components set forth in the following description or illustrated in the drawings. Rather, the invention is capable of other embodiments and being practiced or being carried out in various ways. Also, it is to be understood that the phraseology and terminology used herein are for purposes of description only and should not be regarded as limiting. The use herein of terms such as "including" and "comprising" and variations thereof is meant to encompass the items listed thereafter and equivalents thereof as well as additional items and equivalents thereof.

DETAILED DESCRIPTION

Reference will now be made to the drawings wherein to the extent possible, like elements are designated by like reference numerals throughout the various views. FIG. 1 illustrates an exemplary central box unit or "CBU" 10 such as may be used to collect mail at a central location such as an apartment lobby or the like. As shown, the central box unit 10 includes a number of discreet user boxes 12 of various size and shape. The user boxes 12 may be accessed by individual users using keys to engage locks 14 in a manner as will be well-known to those of skill in the art. Of course, other access techniques such as combination locks, electric locks and the like may also be used, if desired.

In the illustrated exemplary construction, the central box unit 10 also includes at least one so-called letter drop 16 including a slot opening 18 adapted to receive letters, post cards, small parcels, and the like for subsequent pick up by a delivery person. In this regard, it is to be understood and appreciated that in this application the term "mail" is in no way limited to governmental postage. Rather, it is intended that the present invention shall include and extend to any public or private delivery system as may be desired. Moreover, while the central box unit 10 is illustrated as having two generally vertically oriented cabinets, such a construction is merely exemplary and any number of other configurations may be utilized as desired. By way of example only, and not limitation, a larger or smaller number of user boxes may be arranged in a larger or smaller number of cabinet structures.

Figure 2:
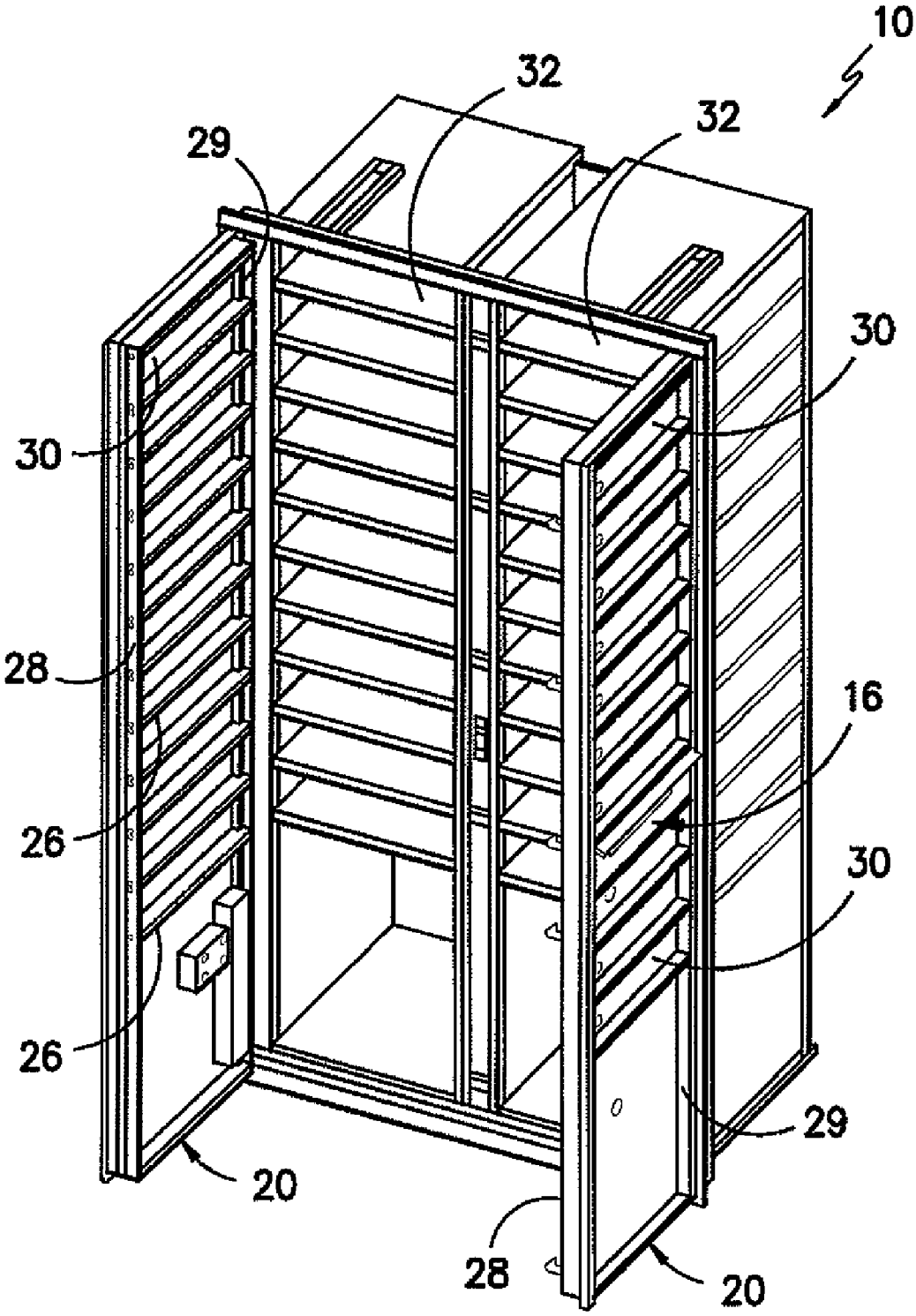
FIG. 2 is a view similar to FIG. 1, with access doors in an open position.

As illustrated in FIG. 2, the central box unit 10 includes an arrangement of general access doors 20 that are adapted to be opened by a delivery person to gain access to the interior compartments of the user boxes 12. By way of example only, and not limitation, this opening may be carried out by use of a master door latch 22 (FIG. 1) which may be manipulated by a delivery person. Such master door latches are well-known to those of skill in the art and form no part of the present invention.

As illustrated in FIG. 2, individual access doors 30 for each of the user boxes 12 are separated by cross bars 26. The cross bars 26 extend across the general access doors 20 between an inboard vertical frame structure 28 and an outboard vertical frame structure 29. The inboard vertical frame structure 28 and the outboard vertical frame structure 29 extend generally along the length of the general access doors 20. The cross bars 26 provide support for the individual access doors 30 that are used to gain access to individual interior compartments 32. The cross bars 26 also project inwardly to a degree to separate the individual interior compartments 32 from one another when the general access doors 20 are in a closed position.

Figure 3:
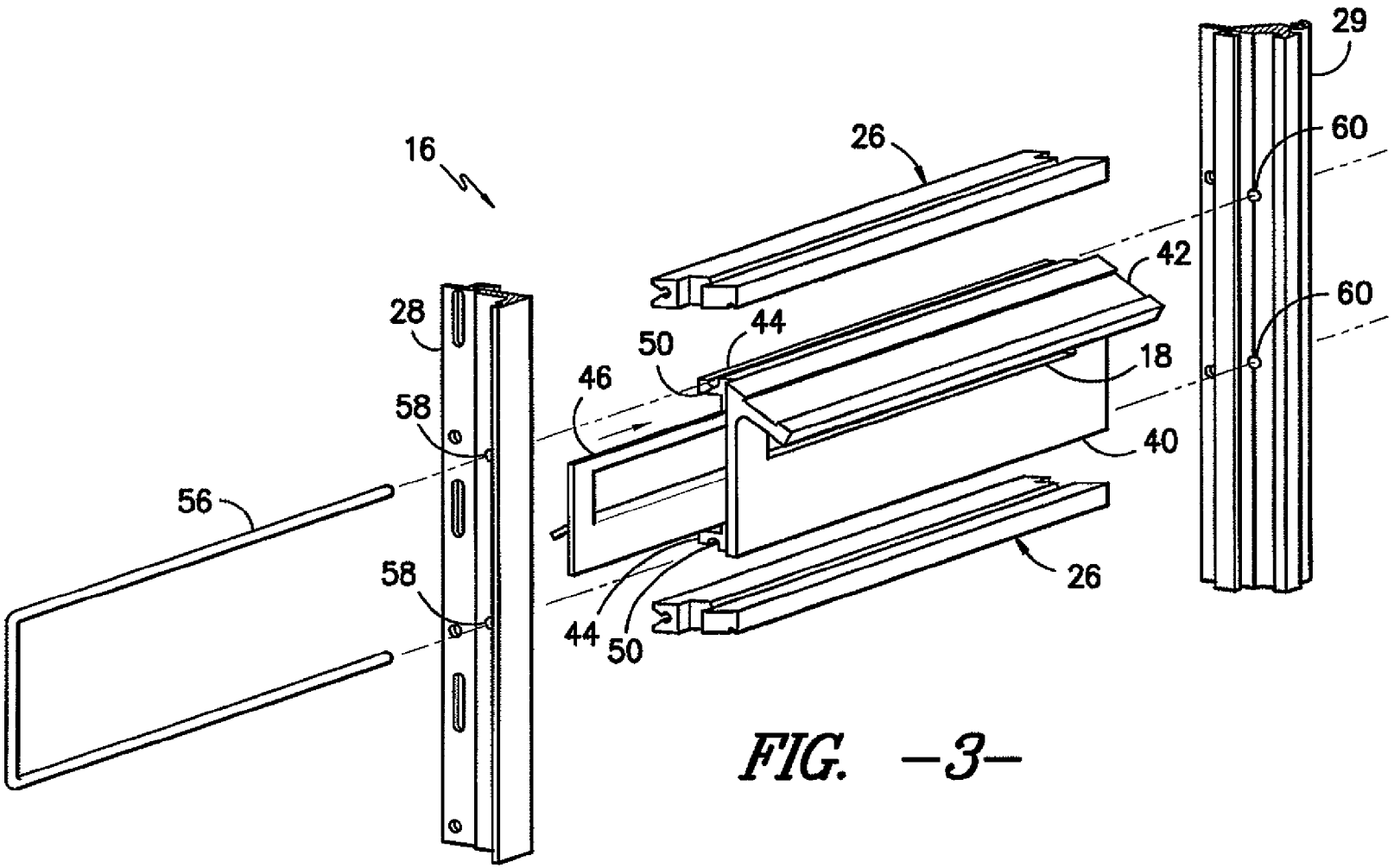
FIG. 3 is an exploded perspective view illustrating an exemplary letter drop assembly consistent with the present disclosure.

As indicated previously, the central box unit 10 includes at least one letter drop structure 16 configured to accept deposit of letters or the like. In accordance with a feature of the present invention, the letter drop structure 16 is adapted for easy removal and replacement by a delivery person when the general access doors 20 are in the open position as illustrated in FIG. 2. By way of example only, and not limitation, an exemplary removable letter drop assembly is illustrated in FIG. 3 in relation to sections of the inboard vertical frame member 28 and the outboard vertical frame member 29. As illustrated, the exemplary letter drop structure 16 includes a slotted body 40 having a length and width substantially corresponding to the shape of the individual access doors 30 for the individual user boxes 12. Thus, the slotted body 40 may be positioned between complimentary crossbars 26 in spanning relation to the inboard vertical frame member 28 and the outboard vertical frame member 29.

As shown, the slotted body 40 includes an angled rain guard 42 extending in covering relation to the slot opening 18. The slotted body 40 also includes a pair of rearwardly extending leg members 44 disposed in generally opposing relation to the adjacent crossbars 26. In the illustrated configuration, the space between the leg members 44 defines a channel for sliding insertion of a anti-fishing security screen 46 as will be described further hereinafter. As shown, the rearwardly extending leg members 44 include open grooves 50 extending along the length dimension of the slotted body 40. The open grooves 50 are disposed along the upper edges of the rearwardly extending leg members 44 facing towards the adjacent crossbars 26.

In the illustrated exemplary construction, the open grooves 50 are disposed in opposing relation to complimentary grooves disposed along the surfaces of the opposing cross bars 26. In the exemplary configuration, the open grooves 50 are configured to accept and retain the legs of an insertable pin member 56. Specifically, in the illustrated construction, the legs of the pin member 56 define elongate pin elements that may be inserted through inboard access openings 58 disposed at the inboard vertical frame member 28. The distal ends of the legs on the pin member 56 are then passed into the corresponding open grooves 50 in aligned relation with the inboard access openings 58. The open grooves 50 are sized to extend partially but not completely about the legs of the pin member 56. In this regard, the cross-sectional geometry of the open grooves 50 is set such that the legs of the pin member 56 may be pushed axially along the length of the open grooves 50. However, the legs of the pin member 56 are blocked against moving radially out of the open grooves 50.

Figure 6A:
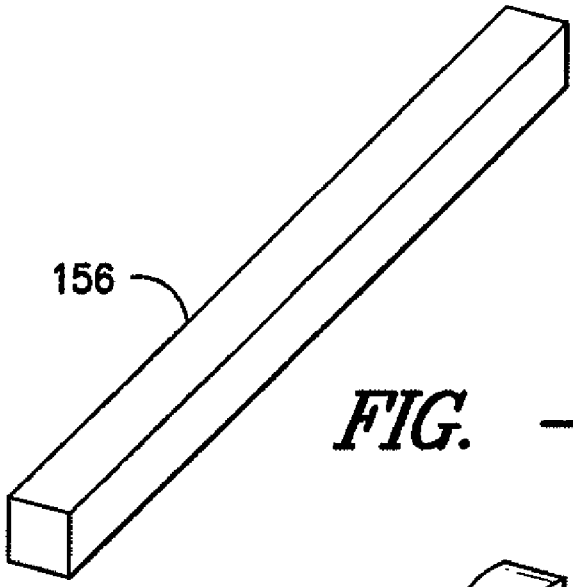
FIGS. 6A-6C illustrate several exemplary alternative geometries for elongate locking pin elements.
Figure 6B:
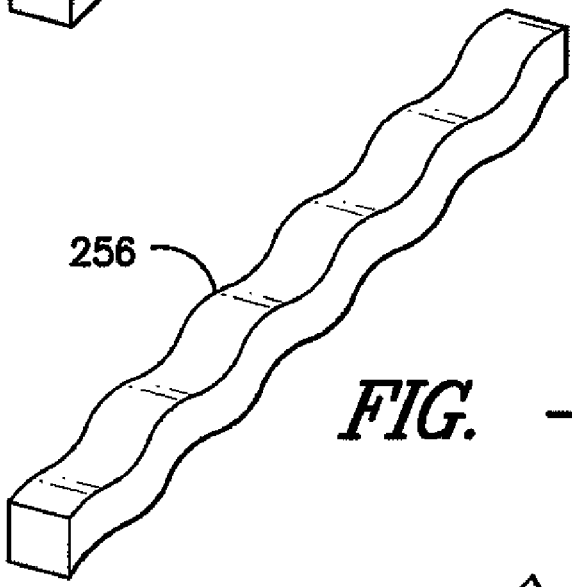
Figure 6C:
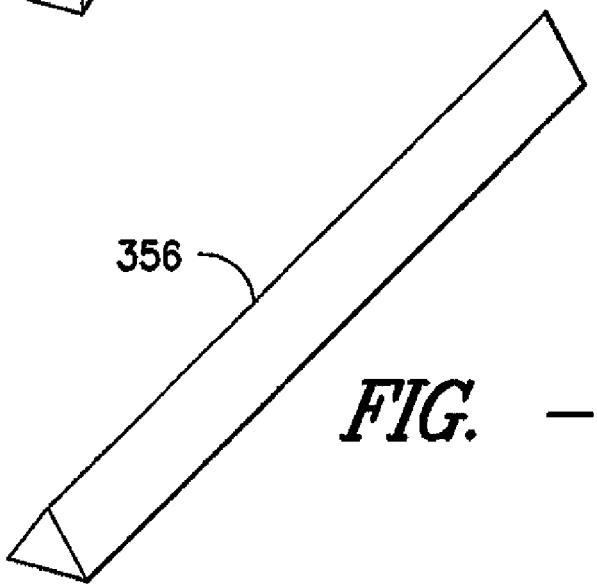

By way of example only, and not limitation, according to the illustrated construction, entrapping engagement between the open grooves 50 and the legs of the pin member 56 may be achieved by providing the open grooves 50 with a partial circular profile such that the walls of the grooves extend around an angle greater than about 180°. Thus, when the legs of the pin member 56 are inserted axially into the open grooves 50, the walls of the grooves extend upwardly beyond the centerline of the legs on the pin member 56 to block outward movement. Of course, it is likewise contemplated that other pin-retaining arrangements may be used such as using open grooves with angled profiles corresponding to legs with angular cross-sections to permit axial insertion while restricting radial withdrawal of the legs. In this regard, while the cross-sectional geometry of the open grooves 50 may be in the form of a partial circle adapted to accept substantially round legs, it is contemplated that other cross-sectional geometries may likewise be used to accept other pin geometries as may be desired. By way of example only and not limitation such alternative geometries may include a square or rectangular cross-sectional pin element 156 with substantially straight planar surfaces (FIG. 6A); a square or rectangular cross-sectional pin element 256 with an undulating surface (FIG. 6B); and a triangular cross-sectional pin element 356 with substantially straight planar surfaces (FIG. 6C) or undulating surfaces (not shown). Each of these may be inserted into an open groove of substantially complementary cross-section. Of course, any number of other cross-sectional geometries may also be used.

As illustrated through reference to FIG. 3, in the final assembled condition the distal ends of the legs on the pin member 56 ultimately extend axially beyond the open grooves 50 and into outboard acceptance openings 60 at the outboard vertical frame member in aligned relation with the axis of the open grooves 50. As will be appreciated, once the legs of the pin member 56 have been fully inserted, the slotted body panel is held in secure relation between the inboard vertical frame member 28 and the outboard vertical frame member 29. The adjacent crossbars 26 are disposed in covering relation to the legs of the pin member 56 and are held in place by screws or other attachment means (not shown) as may be desired.

In the illustrated exemplary construction, the pin member 56 is characterized by a generally "U" shaped configuration with two legs projecting away from a substantially straight cross member. As will be appreciated, such a construction permits a delivery person or other person servicing the letter drop 16 to grasp the cross member as a handle during insertion and removal of the pin member 56. Of course, pin members with other constructions may likewise be utilized. By way of example only, and not limitation, other generally "U" shaped configurations incorporating finger loops at the cross member may be utilized. Individual straight pins with flared heads that can be grasped by a user may also be used if desired.

Referring now to FIG. 4, it may be seen that in the exemplary construction a panel acceptance channel 60 is disposed across a rear surface of the slotted body 40. As indicated previously, the panel acceptance channel 60 is configured to slidingly accept insertion of the anti-fishing security screen 46. As shown in FIG. 4, the panel acceptance channel 60 includes a pair of inwardly extending ears 62 extending along the length of the slotted body 40. The inwardly extending ears 62 are spaced apart from the rear face of the slotted body 40 such that the anti-fishing security screen 46 may slide between the inwardly extending ears 62 and the rear face of the slotted body 40. In this arrangement, the inwardly extending ears 62 serve to prevent the anti-fishing screen 46 from falling out of position.

As illustrated, the anti-fishing security screen 46 includes a window opening 68 which is oriented for substantial alignment with the slot opening 18 in the slotted body 40. Thus, in the assembled condition, a letter or parcel may be inserted through the aligned slot opening 18 and the aligned window opening 68. As seen through joint reference to FIGS. 4 and 5, the anti-fishing screen 46 also includes an arrangement of teeth 70 projecting in downwardly angled relation away from the window opening 68. The teeth 70 provide a barrier against the insertion and manipulation of a wire or other elongate structure to reach and retrieve articles that have been deposited through the slot opening 18. The presence of the teeth 70 may also provide a ramped surface useful in carrying deposited envelopes to a rearward position.

One potential benefit of the illustrated and described construction is the ability to form the slotted body 40 substantially by extrusion techniques. In this regard, it will be noted that the rain guard 42, the open grooves 50, and the panel acceptance channel 60 may all be formed during an extrusion process. The use of such extrusion processing may promote substantial efficiency during the formation process.

Another potentially beneficial feature of the illustrated and described construction is the ability to rapidly remove and replace the letter drop structure 16 in the event of damage. In this regard, it will be appreciated that when the general access doors 20 are in the open position as shown in FIG. 2 the pin member 56 is readily accessible. By simply removing the pin member 56, the engagement between the slotted body 40 and the inboard and outboard vertical frame members 28, 29 is released. Without this engagement, the slotted body 40 may be easily removed by grasping the rain guard 42 or other portion and pulling outwardly. Thereafter, a replacement slotted body 40 may be inserted and locked in place by reinsertion of the pin member 56.

Of course, it is contemplated that any number of other structures and combinations may likewise be utilized. In this regard, it will be appreciated that the foregoing description and drawings provide exemplary embodiments. However, it is contemplated that other implementations of the disclosure may differ in detail from the foregoing examples. Accordingly, this disclosure contemplates the inclusion of all modifications and equivalents of the subject matter disclosed herein as permitted by applicable law. Moreover, any combination of the above-described elements in all possible variations thereof is contemplated unless otherwise indicated herein or otherwise clearly contradicted by context.

Various features of the invention are set forth in the following claims.

What is claimed is:

1. A multi-user mail box unit including at least one deposit opening, the mail box unit comprising:

an interior including a plurality of individually accessible interior storage compartments;

at least one general access door adapted to open and close in relation to the interior, the general access door including an inboard vertical frame member and an outboard vertical frame member;

at least one removable letter drop assembly supported within the general access door between a first crossbar and a second crossbar, the first crossbar and a second crossbar being in spaced relation to one another and extending between the inboard vertical frame member and the outboard vertical frame member, the letter drop assembly including a body portion having a length dimension oriented transverse to the inboard vertical frame member and the outboard vertical frame member, the body portion including a slot defining the deposit opening, the body portion having a first open groove extending in the length dimension along an upper edge of the body portion, the first open groove being disposed in opposing relation to the first crossbar, the body portion having a second open groove extending in the length dimension along a lower edge of the body portion, the second open groove being disposed in opposing relation to the second crossbar;

a displaceable first elongate pin element extending through a first access opening in the inboard vertical frame member and axially through the first open groove, the first elongate pin element including a first distal tip projecting into a first receiving opening within the outboard vertical frame member, the first elongate pin element being axially moveable within the first open groove, the first open groove adapted to block radial displacement of the first elongate pin element when the first elongate pin element is within the first open groove; and a displaceable second elongate pin element extending through a second access opening in the inboard vertical frame member and axially through the second open groove, the second elongate pin element including a second distal tip normally projecting into a second receiving opening within the outboard vertical frame member, the second elongate pin element being axially moveable within the second open groove, the second open groove adapted to block radial displacement of the second elongate pin element when the second elongate pin element is within the second open groove.

2. The multi-user mail box unit as recited in claim 1, wherein the body portion is extruded metal.

3. The multi-user mail box unit as recited in claim 1, wherein the body portion further includes a rain guard extending in angled relation away from the upper edge.

4. The multi-user mail box unit as recited in claim 1, wherein the first elongate pin element and the second elongate pin element are legs of a substantially "U" shaped pin member.

5. The multi-user mail box unit as recited in claim 4, wherein the legs extend away from a substantially straight cross member.

6. The multi-user mail box unit as recited in claim 1, further comprising an anti-fishing security screen disposed across a rear face of the body portion.

7. The multi-user mail box unit as recited in claim 6, wherein the anti-fishing security screen includes a window opening disposed in substantially aligned relation with the slot in the body portion.

8. The multi-user mail box unit as recited in claim 7, wherein the anti-fishing security screen includes a plurality of teeth extending in downwardly angled relation away from the window opening.

9. A multi-user mail box unit including at least one deposit opening, the mail box unit comprising:

an interior including a plurality of individually accessible interior storage compartments;

at least one general access door adapted to open and close in relation to the interior, the general access door including an inboard vertical frame member and an outboard vertical frame member;

at least one removable letter drop assembly supported within the general access door between a first crossbar and a second crossbar, the first crossbar and a second crossbar being in spaced relation to one another and extending between the inboard vertical frame member and the outboard vertical frame member, the letter drop assembly including a body portion having a length dimension oriented transverse to the inboard vertical frame member and the outboard vertical frame member, the body portion including a slot defining the deposit opening, the body portion having a first open groove extending in the length dimension along an upper edge of the body portion, the first open groove being disposed in opposing relation to the first crossbar, the body portion having a second open groove extending in the length dimension along a lower edge of the body portion, the second open groove being disposed in opposing relation to the second crossbar, the body portion including a panel acceptance channel disposed across a rear surface of the body portion, the panel acceptance channel including a pair of opposing ears disposed in raised, spaced relation to the rear surface of the body portion;

an anti-fishing security screen held slidingly within the panel acceptance channel;

a displaceable first elongate pin element extending through a first access opening in the inboard vertical frame member and axially through the first open groove, the first elongate pin element including a first distal tip projecting into a first receiving opening within the outboard vertical frame member, the first elongate pin element being axially moveable within the first open groove, the first open groove adapted to block radial displacement of the first elongate pin element when the first elongate pin element is within the first open groove; and a displaceable second elongate pin element extending through a second access opening in the inboard vertical frame member and axially through the second open groove, the second elongate pin element including a second distal tip normally projecting into a second receiving opening within the outboard vertical frame member, the second elongate pin element being axially moveable within the second open groove, the second open groove adapted to block radial displacement of the second elongate pin element when the second elongate pin element is within the second open groove.

10. The multi-user mail box unit as recited in claim 9, wherein the body portion is extruded metal.

11. The multi-user mail box unit as recited in claim 10, wherein the metal is selected from the group consisting of steel and aluminum.

12. The multi-user mail box unit as recited in claim 9, wherein the body portion further includes a rain guard extending in angled relation away from the upper edge.

13. The multi-user mail box unit as recited in claim 9, wherein the first elongate pin element and the second elongate pin element are legs of a substantially "U" shaped pin member.

14. The multi-user mail box unit as recited in claim 1, wherein the legs extend away from a substantially straight cross member.

15. The multi-user mail box unit as recited in claim 9, wherein the anti-fishing security screen includes a window opening disposed in substantially aligned relation with the slot in the body portion.

16. The multi-user mail box unit as recited in claim 15, wherein the anti-fishing security screen includes a plurality of teeth extending in downwardly angled relation away from the window opening.

17. The multi-user mail box unit as recited in claim 15, wherein the anti-fishing security screen is metal.

* * * * *